US008497830B2

(12) United States Patent
Liu et al.

(10) Patent No.: US 8,497,830 B2
(45) Date of Patent: Jul. 30, 2013

(54) LIQUID CRYSTAL DISPLAY DEVICE AND METHOD FOR DRIVING THE SAME

(75) Inventors: Chun-Hsin Liu, Hsin-Chu (TW); Li-Min Fu, Hsin-Chu (TW); Chi-Wen Chen, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 1062 days.

(21) Appl. No.: 12/104,863

(22) Filed: Apr. 17, 2008

(65) Prior Publication Data

US 2009/0109357 A1 Apr. 30, 2009

(30) Foreign Application Priority Data

Oct. 30, 2007 (TW) ..... 96140852 A

(51) Int. Cl.
*G09G 3/36* (2006.01)

(52) U.S. Cl.
USPC ..... 345/92

(58) Field of Classification Search
USPC ..... 345/92, 96; 349/143, 144
See application file for complete search history.

(56) References Cited

U.S. PATENT DOCUMENTS

| | | | | |
|---|---|---|---|---|
| 4,781,438 | A * | 11/1988 | Noguchi | 349/54 |
| 5,457,552 | A * | 10/1995 | Ogurtsov et al. | 349/54 |
| 6,075,505 | A * | 6/2000 | Shiba et al. | 345/87 |
| 6,259,504 | B1 * | 7/2001 | Shin et al. | 349/144 |
| 6,552,706 | B1 * | 4/2003 | Ikeda et al. | 345/96 |
| 6,707,441 | B1 * | 3/2004 | Hebiguchi et al. | 345/92 |
| 6,897,845 | B2 | 5/2005 | Ozawa | |
| 7,755,591 | B2 | 7/2010 | Yeh | |
| 2004/0104872 | A1 * | 6/2004 | Kang et al. | 345/87 |
| 2005/0243045 | A1 * | 11/2005 | Kim | 345/87 |
| 2006/0007213 | A1 | 1/2006 | Hashimoto et al. | |
| 2006/0267897 | A1 | 11/2006 | Lin | |
| 2007/0069214 | A1 | 3/2007 | Lee | |
| 2007/0176874 | A1 * | 8/2007 | Yeh | 345/92 |
| 2008/0074377 | A1 * | 3/2008 | Fujita | 345/96 |

FOREIGN PATENT DOCUMENTS

| | | | |
|---|---|---|---|
| CN | 1360297 | A | 7/2002 |
| CN | 1705010 | A | 12/2005 |
| CN | 1941061 | A | 10/2008 |
| TW | 594111 | | 6/2004 |
| TW | 200617499 | A | 6/2006 |

OTHER PUBLICATIONS

English translation of abstract and pertinent parts of TW 200617499 A, Jun. 1, 2006.
English translation of abstract and pertinent parts of CN 1360297 A, Jul. 24, 2002.
English translation of abstract and pertinent parts of TW 594111, Jun. 21, 2004.

* cited by examiner

*Primary Examiner* — Chanh Nguyen
*Assistant Examiner* — Roy Rabindranath
(74) *Attorney, Agent, or Firm* — McClure, Qualey & Rodack, LLP

(57) ABSTRACT

A method for driving a liquid crystal display device includes the following steps. A driving circuit and a display unit are provided, the driving circuit comprising a plurality of data lines for transferring data voltages to drive the display unit, wherein each adjacent two of the data lines are supplied with voltages of opposite polarities, and all the data lines in one frame period are supplied with voltages of the same polarity. Two adjacent pixel areas are combined to form one pixel unit, wherein the two adjacent pixel areas are supplied with the same polarity, and the adjacent two pixel units are supplied with opposite polarities.

5 Claims, 5 Drawing Sheets

LIQUID CRYSTAL DISPLAY DEVICE AND METHOD FOR DRIVING THE SAME

RELATED APPLICATIONS

This application claims priority to Taiwan Patent Application Serial Number 96140852, filed Oct. 30, 2007, which is herein incorporated by reference.

BACKGROUND

1. Field of Invention

The present invention relates to a liquid crystal display device. More particularly, the present invention relates to a pixel structure and its driving method of a liquid crystal display device.

2. Description of Related Art

During driving a liquid crystal display device, a driving voltage cannot be fixed at a voltage value, otherwise characteristics of crystal molecules might be damaged by a long-period driving. Therefore, every now and then, the driving voltage must be altered to avoid such damages upon the crystal molecules.

In order to solve this issue, driving phases for the liquid crystal display device are divided into two types: positive polarity and negative polarity. When a pixel electrode is supplied with a higher voltage than a common electrode is supplied with, the pixel is positively polarized. When a pixel electrode is supplied with a lower voltage than a common electrode is supplied with, the pixel is negatively polarized. When a voltage difference between the pixel electrode and the common electrode is the same, the same grayness would be presented by the pixel.

Several conventional polarity inversions between positive polarity and negative polarity are listed as follows: frame inversion, row inversion, column inversion and dot inversion.

When a frame refreshes, flickers are generated by the liquid crystal display device and make human eyes uncomfortable. The flickers are most-frequently generated when the frame inversion is applied in the liquid crystal display device. Other inversion ways may produce the flickers, but not as frequent as the frame inversion does.

Another issue of the liquid crystal display device is "cross talk", which means adjacent pixels interfere with each other, thereby displaying incorrect information. Dot inversion is the best way to reduce cross talk, but also consumes more power than the other inversion ways. How to reduce "cross talk", "flicker" and consume less power in a liquid crystal display device is an urgent issue for those persons skilled in the art.

For the forgoing reasons, there is a need for an improved pixel structure and its driving method of a liquid crystal display device.

SUMMARY

It is therefore an objective of the present invention to provide a pixel structure and its driving method of a liquid crystal display device.

In accordance with the foregoing and other objectives of the present invention, a method for driving a liquid crystal display device includes the following steps. A driving circuit and a display unit are provided, the driving circuit comprising a plurality of data lines for transferring data voltages to drive the display unit, wherein each adjacent two of the data lines are supplied with voltages of opposite polarities, and all the data lines in one frame period are supplied with voltages of the same polarity. Two adjacent pixel areas are combined to form one pixel unit, wherein the two adjacent pixel areas are supplied with the same polarity, and the adjacent two pixel units are supplied with opposite polarities.

In accordance with the foregoing and other objectives of the present invention, a liquid crystal display device comprises a plurality of data lines, a plurality of scan lines, a transistor, a first pixel unit and a second pixel unit. The data lines are substantially in parallel with one another. The scan lines are perpendicularly crossed the data lines, one pixel areas is defined as an overlapped area of the area between the two adjacent data lines and the area between the two adjacent scan lines, whereby a plurality of pixel areas are formed among the data lines and the scan lines. The transistor comprises a gate electrode, a source electrode and a drain electrode. The transistor is disposed within each of the pixel areas and electrically connected to the data lines and the scan lines. The first pixel unit includes adjacent two of the pixel areas and the two transistors, wherein the drain electrodes of the two transistors are respectively connected to different two of the data lines. The second pixel unit includes adjacent two of the pixel areas and the two transistors, wherein the drain electrodes of the two transistors are respectively connected to one of the data lines, the second pixel unit is immediately adjacent to the first pixel unit.

In accordance with the foregoing and other objectives of the present invention, a liquid crystal display device includes the following components. A plurality of data lines includes a first data line, a second data line, a third data line, a fourth data line and fifth data line, which are serially arranged and substantially in parallel with one another. A plurality of scan lines are perpendicularly crossed the data lines. One pixel area is defined as an overlapped area of the area between the two adjacent data lines and the area between the two adjacent scan lines, whereby a plurality of pixel areas are formed among the data lines and the scan lines, and the scan lines comprises a first scan line, a second scan line and a third scan line. Each of a plurality of crystal capacitors is disposed within each pixel area. Each of transistors includes a gate electrode, a source electrode and a drain electrode, and the transistor is electrically connected to one of the data lines, one of crystal capacitors and one of the scan lines. The transistors includes as follows:

A first transistor includes its drain electrode electrically connected to the first data line and its gate electrode electrically connected to the first scan line or the second scan line;

A second transistor includes its drain electrode electrically connected to the third data line and its gate electrode electrically connected to the first scan line or the second scan line;

A third transistor includes its drain electrode electrically connected to the fourth data line and its gate electrode electrically connected to the first scan line or the second scan line;

A fourth transistor includes its drain electrode electrically connected to the fourth data line and its gate electrode electrically connected to the first scan line or the second scan line;

A fifth transistor includes its drain electrode electrically connected to the second data line and its gate electrode electrically connected to the second scan line or the third scan line;

A sixth transistor includes its drain electrode electrically connected to the second data line and its gate electrode electrically connected to the second scan line or the third scan line;

A seventh transistor includes its drain electrode electrically connected to the third data line and its gate electrode electrically connected to the second scan line or the third scan line; and An eighth transistor includes its drain electrode electrically connected to the fifth data line and its gate electrode electrically connected to the second scan line or the third scan line.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE EMBODIMENTS

Figure 1:
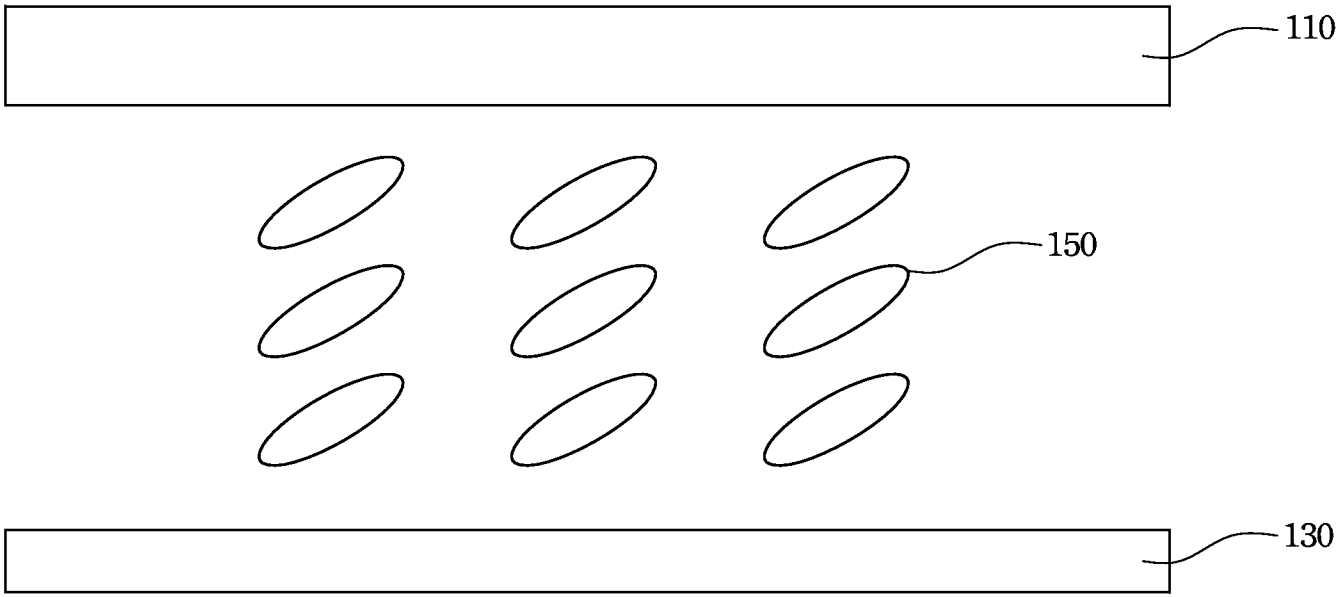
FIG. 1 illustrates a cross-sectional view of a pixel structure according to one embodiment of this invention.

Reference will now be made in detail to the present embodiments of the invention, examples of which are illustrated in the accompanying drawings. Wherever possible, the same reference numbers are used in the drawings and the description to refer to the same or like parts.

FIG. 1 illustrates a cross-sectional view of a pixel structure according to one embodiment of this invention. A plurality of crystal molecules 15 are disposed between a pixel electrode 11 and a common electrode 13. A driving circuit (not illustrated in FIG. 1) supplies the pixel electrode 11 with an electrical voltage while a power supply (not illustrated in FIG. 1) supplies the common electrode 13 with an electrical voltage, thereby driving the crystal molecules 15 to rotate according to an electrical field so as to affect the light transmission rate thereof.

Figure 2:
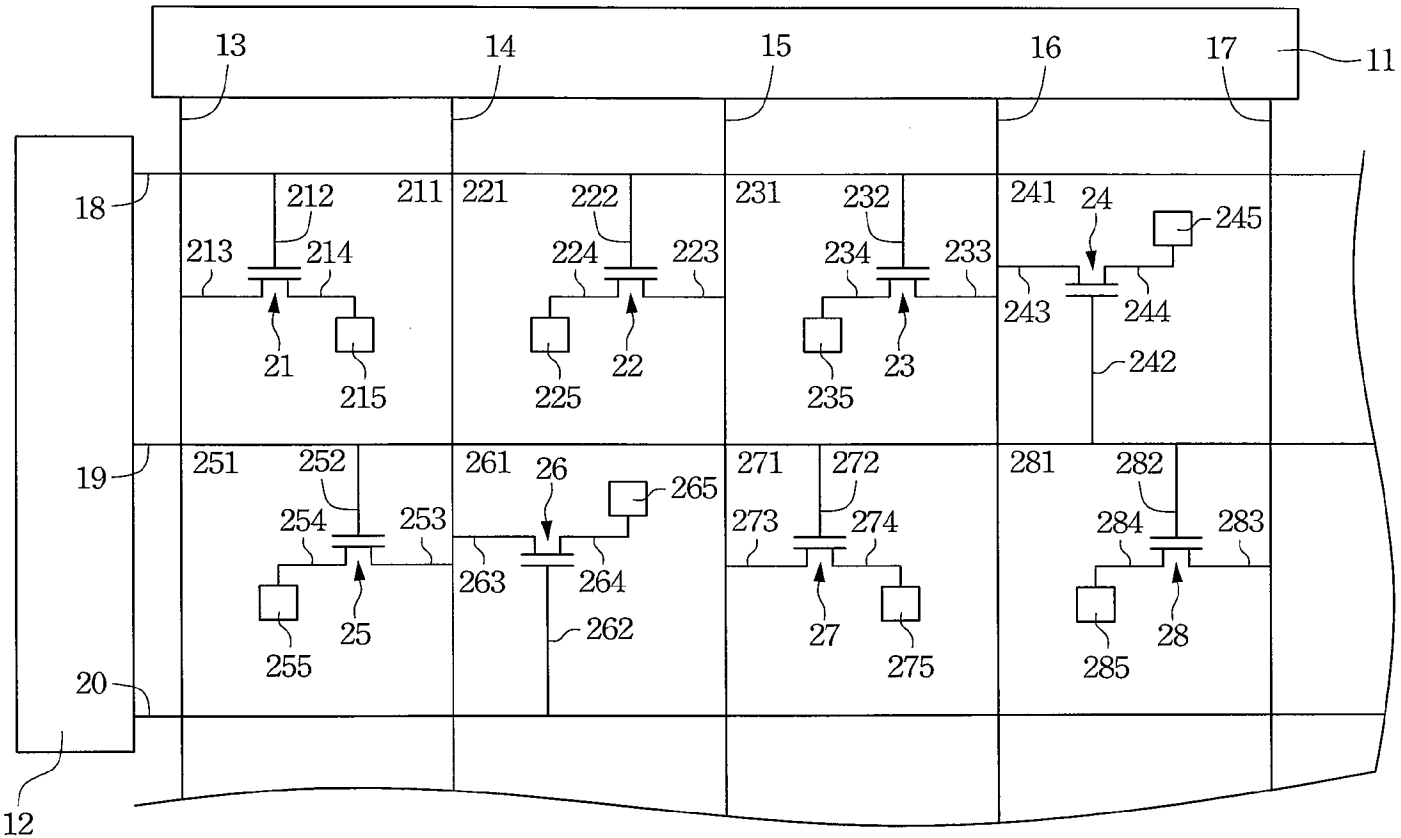
FIG. 2 illustrates a pixel structure according to a first embodiment of this invention.

FIG. 2 illustrates a pixel structure according to a first embodiment of this invention. A data driving circuit 11 supplies data voltages via those data lines (13, 14 . . . 17) while a scan driving circuit 12 supplies scan voltages via those scan lines (18, 19, 20).

A pixel area 211 is defined as an overlapped area of the area between the two adjacent data lines (13, 14) and the area between the two adjacent scan lines (18, 19). Other pixel areas (221, 231, 241 . . . ) are then defined by the same ways. The pixel area 211 includes a transistor 21 and a crystal capacitor 215, which contains the crystal molecules 15 as illustrated in FIG. 1.

In the first embodiment of this invention, only 8 (2×4) pixels are illustrated as those 8 pixels as an unit will be repeated in a display unit. There are eight pixel areas: a first pixel area 211, a second pixel area 221, a third pixel area 231, a fourth pixel area 241, a fifth pixel area 251, a sixth pixel area 261, a seventh area 271 and an eighth area 281. Five data lines (13, 14, 15, 16, 17) and three scan lines (18, 19, 20) are used to define those eight pixel areas, where the data lines are electrically connected to drain electrodes of transistors within each pixel, and the scan lines are electrically connected to gate electrodes of transistors within each pixel. The electrical connection details of each transistor in the first embodiment are described as follows:

In the pixel area 211, a transistor 21 has a drain electrode 213 electrically connected to a first data line 13, a source electrode 214 electrically connected to a first crystal capacitor 215 and a gate electrode 212 electrically connected to a first scan line 18.

In the pixel area 221, a transistor 22 has a drain electrode 223 electrically connected to a third data line 15, a source electrode 224 electrically connected to a second crystal capacitor 225 and a gate electrode 222 electrically connected to a first scan line 18.

In the pixel area 231, a transistor 23 has a drain electrode 233 electrically connected to a fourth data line 16, a source electrode 234 electrically connected to a third crystal capacitor 235 and a gate electrode 232 electrically connected to a first scan line 18.

In the pixel area 241, a transistor 24 has a drain electrode 243 electrically connected to a fourth data line 16, a source electrode 244 electrically connected to a fourth crystal capacitor 245 and a gate electrode 242 electrically connected to a second scan line 19.

In the pixel area 251, a transistor 25 has a drain electrode 253 electrically connected to a second data line 14, a source electrode 254 electrically connected to a fifth crystal capacitor 255 and a gate electrode 252 electrically connected to a second scan line 19.

In the pixel area 261, a transistor 26 has a drain electrode 263 electrically connected to a second data line 14, a source electrode 264 electrically connected to a sixth crystal capacitor 265 and a gate electrode 262 electrically connected to a third scan line 20.

In the pixel area 271, a transistor 27 has a drain electrode 273 electrically connected to a third data line 15, a source electrode 274 electrically connected to a seventh crystal capacitor 275 and a gate electrode 272 electrically connected to a second scan line 19.

In the pixel area 281, a transistor 28 has a drain electrode 283 electrically connected to a fifth data line 17, a source electrode 284 electrically connected to an eighth crystal capacitor 285 and a gate electrode 282 electrically connected to a second scan line 19.

Figure 5B:
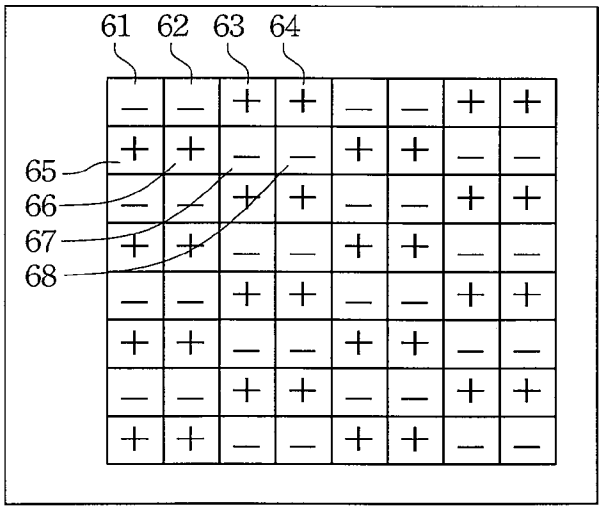
FIG. 5B illustrates a polarity distribution of a second frame based upon the pixel structure and its driving method according to one embodiment of this invention.
Figure 5A:
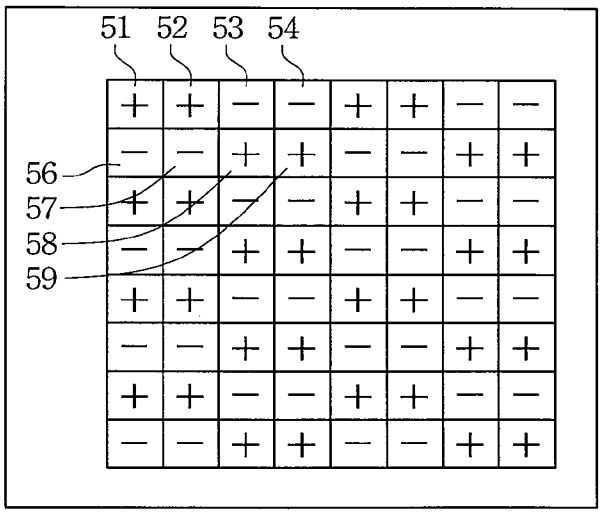
FIG. 5A illustrates a polarity distribution of a first frame based upon the pixel structure and its driving method according to one embodiment of this invention.

Given the first embodiment of the pixel structure, the first crystal capacitor 215, the second crystal capacitor 225, the seventh crystal capacitor 275 and the eighth crystal capacitor 285 can be operated with the same polarity while the third crystal capacitor 235, the fourth crystal capacitor 245, the fifth crystal capacitor 255 and the sixth crystal capacitor 265 can also be operated with the same polarity. For example (as illustrated in FIG. 5A), a first frame is achieved by supplying pixel areas (51, 52, 58, 59) with positive polarity and supplying pixel areas (53, 54, 56, 57) with negative polarity.

For the next frame (a second frame), the first crystal capacitor 215, the second crystal capacitor 225, the seventh crystal capacitor 275 and the eighth crystal capacitor 285 can be operated with the same polarity but opposite to the first frame while the third crystal capacitor 235, the fourth crystal capacitor 245, the fifth crystal capacitor 255 and the sixth crystal capacitor 265 can also be operated with the same polarity but opposite to the first frame. For example (as illustrated in FIG. 5B), the second frame is achieved by supplying pixel areas (61, 62, 67, 68) with negative polarity and supplying pixel areas (63, 64, 65, 66) with positive polarity.

By combining two pixel areas as a pixel unit, adjacent two pixel units can be operated with opposite polarities, thereby reducing "cross talk" using column inversion to drive the pixel structure. Besides, using column inversion to drive the pixel structure has advantages of lower power consumptions and lessened flickers, thereby improving display quality.

In a conventional LCD device, for example, 16 transistors are respectively connected to one scan line while the 16 transistors are respectively connected to 16 data lines. In embodiments of this invention, for example, gate electrodes of 16 transistors are respectively connected to one of several scan lines while 17 data lines supply data voltages to 16 crystal capacitors. One more data line is used compared to the conventional LCD device. In another embodiment of this invention, a LCD device has 8 transistors, which are electrically connected to one of the data lines while 9 scan lines are electrically connected to gate electrodes of the 8 transistors. One more scan line is used compared to the conventional LCD device.

Figure 3:
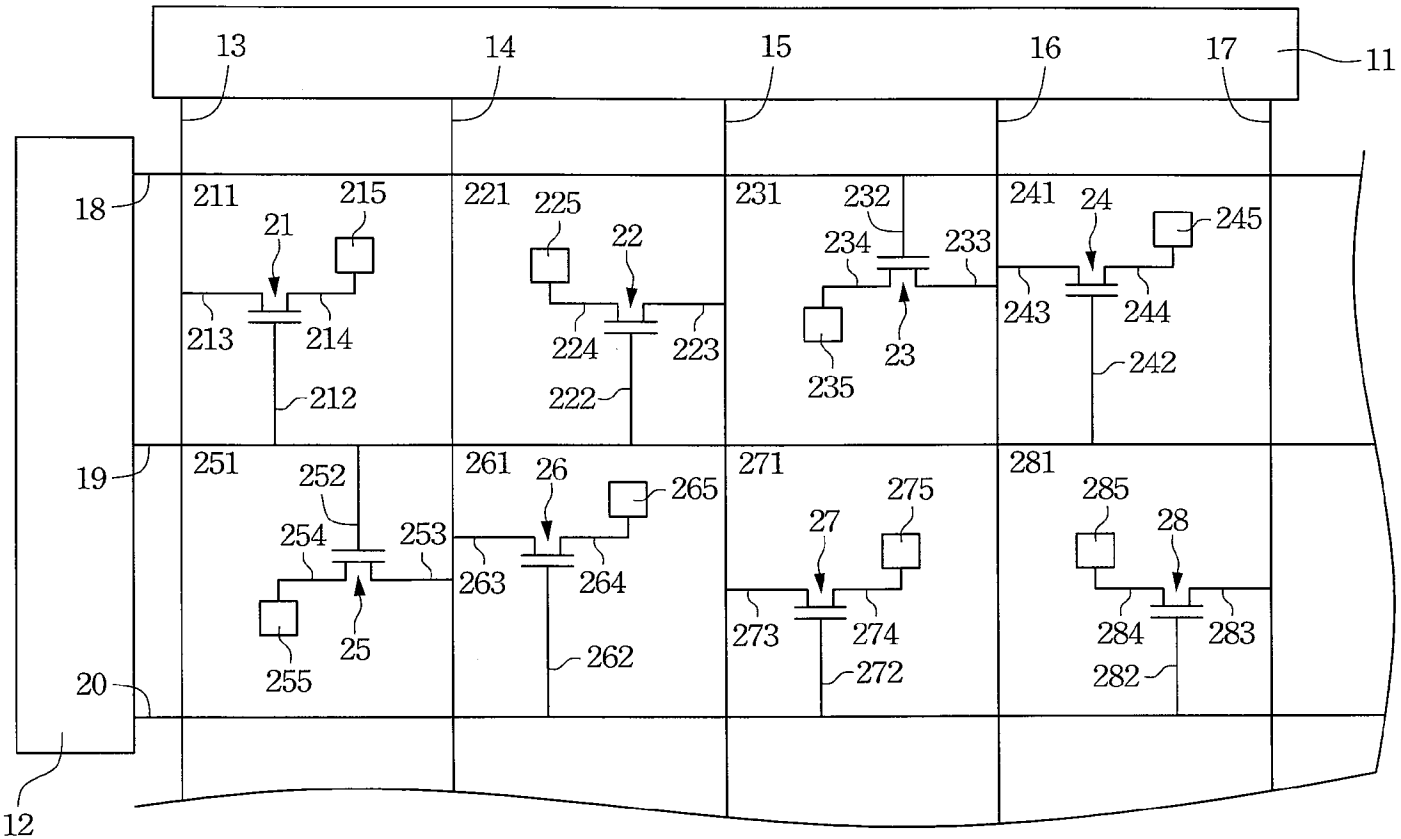
FIG. 3 illustrates a pixel structure according to a second embodiment of this invention.

FIG. 3 illustrates a pixel structure according to a second embodiment of this invention. Compared to the first embodiment, gate electrodes of transistors (21, 22, 27, 28) are respectively electrically connected a different scan line. The electrical connection details of each transistor in the second embodiment are described as follows:

In the pixel area 211, a transistor 21 has a drain electrode 213 electrically connected to a first data line 13, a source electrode 214 electrically connected to a first crystal capacitor 215 and a gate electrode 212 electrically connected to a second scan line 19.

In the pixel area 221, a transistor 22 has a drain electrode 223 electrically connected to a third data line 15, a source electrode 224 electrically connected to a second crystal capacitor 225 and a gate electrode 222 electrically connected to a second scan line 19.

In the pixel area 231, a transistor 23 has a drain electrode 233 electrically connected to a fourth data line 16, a source electrode 234 electrically connected to a third crystal capacitor 235 and a gate electrode 232 electrically connected to a first scan line 18.

In the pixel area 241, a transistor 24 has a drain electrode 243 electrically connected to a fourth data line 16, a source electrode 244 electrically connected to a fourth crystal capacitor 245 and a gate electrode 242 electrically connected to a second scan line 19.

In the pixel area 251, a transistor 25 has a drain electrode 253 electrically connected to a second data line 14, a source electrode 254 electrically connected to a fifth crystal capacitor 255 and a gate electrode 252 electrically connected to a second scan line 19.

In the pixel area 261, a transistor 26 has a drain electrode 263 electrically connected to a second data line 14, a source electrode 264 electrically connected to a sixth crystal capacitor 265 and a gate electrode 262 electrically connected to a third scan line 20.

In the pixel area 271, a transistor 27 has a drain electrode 273 electrically connected to a third data line 15, a source electrode 274 electrically connected to a seventh crystal capacitor 275 and a gate electrode 272 electrically connected to a third scan line 20.

In the pixel area 281, a transistor 28 has a drain electrode 283 electrically connected to a fifth data line 17, a source electrode 284 electrically connected to an eighth crystal capacitor 285 and a gate electrode 282 electrically connected to a third scan line 20.

As the crystal capacitor's polarity inversion is subject to data voltages, data lines connection in this embodiment is the same as the first embodiment, thereby producing the results as illustrated FIG. 5A and FIG. 5B. Using column inversion to drive the pixel structure has advantages of lower power consumptions and lessened flickers, thereby improving display quality.

Figure 4:
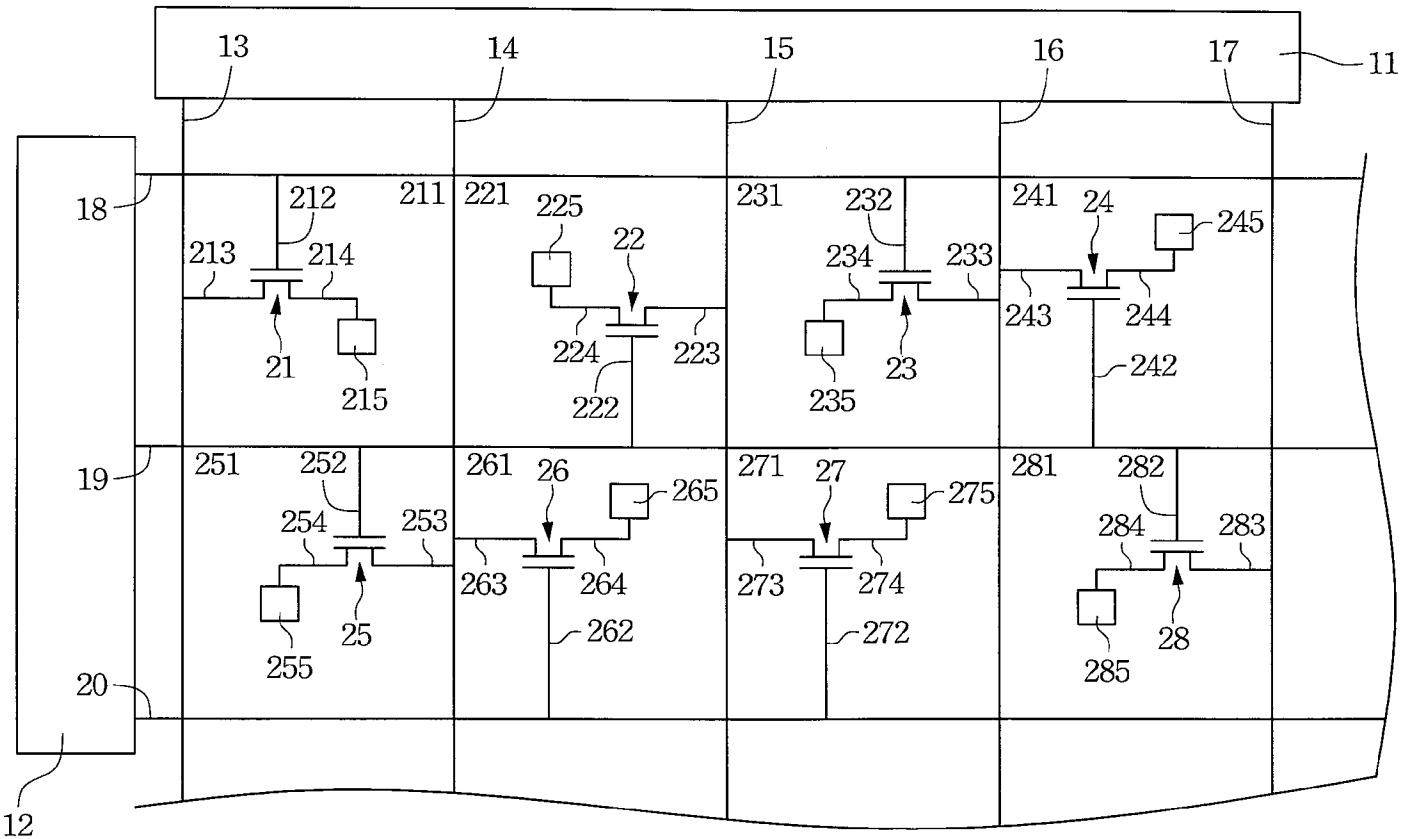
FIG. 4 illustrates a pixel structure according to a third embodiment of this invention.

FIG. 4 illustrates a pixel structure according to a third embodiment of this invention. Compared to the first embodiment, gate electrodes of transistors (22, 27) are respectively electrically connected with a different scan line. The electrical connection details of each transistor in the third embodiment are described as follows:

In the pixel area 211, a transistor 21 has a drain electrode 213 electrically connected to a first data line 13, a source electrode 214 electrically connected to a first crystal capacitor 215 and a gate electrode 212 electrically connected to a first scan line 18.

In the pixel area 221, a transistor 22 has a drain electrode 223 electrically connected to a third data line 15, a source electrode 224 electrically connected to a second crystal capacitor 225 and a gate electrode 222 electrically connected to a second scan line 19.

In the pixel area 231, a transistor 23 has a drain electrode 233 electrically connected to a fourth data line 16, a source electrode 234 electrically connected to a third crystal capacitor 235 and a gate electrode 232 electrically connected to a first scan line 18.

In the pixel area 241, a transistor 24 has a drain electrode 243 electrically connected to a fourth data line 16, a source electrode 244 electrically connected to a fourth crystal capacitor 245 and a gate electrode 242 electrically connected to a second scan line 19.

In the pixel area 251, a transistor 25 has a drain electrode 253 electrically connected to a second data line 14, a source electrode 254 electrically connected to a fifth crystal capacitor 255 and a gate electrode 252 electrically connected to a second scan line 19.

In the pixel area 261, a transistor 26 has a drain electrode 263 electrically connected to a second data line 14, a source electrode 264 electrically connected to a sixth crystal capacitor 265 and a gate electrode 262 electrically connected to a third scan line 20.

In the pixel area 271, a transistor 27 has a drain electrode 273 electrically connected to a third data line 15, a source electrode 274 electrically connected to a seventh crystal capacitor 275 and a gate electrode 272 electrically connected to a third scan line 20.

In the pixel area 281, a transistor 28 has a drain electrode 283 electrically connected to a fifth data line 17, a source electrode 284 electrically connected to an eighth crystal capacitor 285 and a gate electrode 282 electrically connected to a second scan line 19.

As the crystal capacitor's polarity inversion is subject to data voltages, data lines connection in this embodiment is the same as the first embodiment, thereby producing the results as illustrated FIG. 5A and FIG. 5B. Using column inversion to drive the pixel structure has advantages of lower power consumptions and lessened flickers, thereby improving display quality.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A liquid crystal display device comprising:

a plurality of data lines comprising a first data line, a second data line, a third data line, a fourth data line and a fifth data line, being sequentially arranged and substantially in parallel with one another;

a plurality of scan lines being perpendicularly crossed the data lines, one pixel area being defined as an overlapped area of the area between the two adjacent data lines and the area between the two adjacent scan lines, whereby a plurality of pixel areas are formed among the data lines and the scan lines, and the scan lines comprises a first scan line, a second scan line and a third scan line, being sequentially arranged and substantially in parallel with one another;

a plurality of transistors, each of the transistors comprising a gate electrode, a source electrode and a drain electrode, the transistors being electrically connected to one of the data lines and one of the scan lines, wherein the transistors comprising:

a first transistor, comprising its drain electrode electrically connected to the first data line and receive a first data signal from the first data line and its gate electrode electrically connected to the first scan line and receive a first gate signal from the first scan line;

a second transistor, comprising its drain electrode electrically connected to the third data line and receive a third data signal from the third data line and its gate electrode electrically connected to the second scan line and receive a second gate signal from the second scan line;

a third transistor, comprising its drain electrode electrically connected to the fourth data line and receive a fourth data signal from the forth data line and its gate electrode electrically connected to the first scan line and receive a first gate signal from the first scan line;

a fourth transistor, comprising its drain electrode electrically connected to the fourth data line and receive a fourth data signal from the forth data line and its gate electrode electrically connected to the second scan line and receive a second gate signal from the second scan line, wherein each of the pixel areas has only one transistor.

2. The liquid crystal display device of claim 1, further comprising:

a fifth transistor, comprising its drain electrodes electrically connected to the second data line and receive a second data signal from the second data line and its gate electrode electrically connected to the second scan line and receive a second gate signal from the second scan line, and a sixth transistor, comprising its drain electrodes electrically connected to the second data line and receive a second data signal from the second data line and its gate electrode electrically connected to the third scan line and receive a third gate signal from the third scan line.

3. The liquid crystal display device of claim 1, further comprising:

a seventh transistor, comprising its drain electrode electrically connected to the third data line and receive a third data signal from the third data line and its gate electrode electrically connected to the third scan line and receive a third gate signal from the third scan line; and an eighth transistor, comprising its drain electrode electrically connected to the fifth data line and receive a fifth data signal from the fifth data line and its gate electrode electrically connected to the second scan line and receive a second gate signal from the second scan line, wherein the eighth transistor is immediately adjacent to the seventh transistor.

4. A driving method for the liquid crystal display device as claimed in claim 2, comprising:

providing the liquid crystal display device as claimed in claim 2; and combining the two adjacent pixel areas to form one pixel unit, wherein the two adjacent pixel areas are supplied with the same polarity, and the adjacent two pixel units are supplied with opposite polarities.

5. A driving method for the liquid crystal display device as claimed in claim 3, comprising:

providing the liquid crystal display device as claimed in claim 3; and combining the two adjacent pixel areas to form one pixel unit, wherein the two adjacent pixel areas are supplied with the same polarity, and the adjacent two pixel units are supplied with opposite polarities.

* * * * *